United States Patent [19]

Parsons

[11] 4,348,972

[45] Sep. 14, 1982

[54] MULTIPURPOSE TRIMARAN

[76] Inventor: Vaughan V. Parsons, 25640 Via Crotalo, Carmel, Calif. 93921

[21] Appl. No.: 152,596

[22] Filed: May 23, 1980

[51] Int. Cl.[3] ..... B63B 1/12

[52] U.S. Cl. ..... 114/61; 114/56; 114/290; 114/357

[58] Field of Search ..... 9/1.5, 6 R, 6 P; 114/61, 56, 39, 90, 123, 288–290

[56] References Cited

U.S. PATENT DOCUMENTS

| | | | |
|---|---|---|---|
| 3,236,202 | 2/1966 | Quady | 114/61 |
| 3,316,873 | 5/1967 | Dismukes | 114/61 |
| 3,604,440 | 9/1971 | Wilson | 9/1.5 |
| 3,726,245 | 4/1973 | Crichter | 114/61 |
| 3,996,871 | 12/1976 | Boismard | 114/61 |
| 3,996,874 | 12/1976 | Winch | 114/123 |
| 4,016,823 | 4/1977 | Davis | 114/90 |
| 4,091,761 | 5/1978 | Fehn | 114/61 |

*Primary Examiner*—Trygve M. Blix
*Assistant Examiner*—D. W. Keen
*Attorney, Agent, or Firm*—Phillips, Moore, Lempio & Majestic

[57] ABSTRACT

Generally, different boats are needed for pulling water-skiers, sailing, fishing and camping. The reason for this is that a boat which would efficiently operate for all of these purposes, and which was sufficiently small to be trailerable, has not been available. Herein, a boat structure (10) is disclosed having a central hull (12) which is of a width (W) at the waterline (26) when floating at rest. A pair of side hulls (32,34) have infacing sides (36,38) which are equally spaced a distance which is from about two-thirds to about four-thirds of the width (W), from the plane (24). Bottom portions (44,46) of the side hulls (32,34) are spaced above a lowermost portion (14) of the central hull (12) and are positioned below the water line (26) when the hull (12) is at rest. Substantial horizontal port and starboard bridges (52,54) are spaced above the waterline (26), extend substantially the length of the side hulls (32,34) and connect top portions (40,42) of the side hulls (32,34) to upper portions (20,22) of lateral sides (16,18) of the central hull (12).

16 Claims, 7 Drawing Figures

MULTIPURPOSE TRIMARAN

DESCRIPTION

1. Technical Field

The present invention relates to a boat structure, more particularly a trimaran boat structure, which is trailerable and which can be used efficiently for power boat operation and for sailing.

2. Background Art

The use of trimaran hulls is relatively well known for sailing craft. However, such hulls have seldom, if ever, been used for power boats. In particular, such hulls have not been used for boats which have sufficient power to pull water-skiers at a high rate of speed across the surface of the water. Also, skier pulling power boats do not generally have sufficient space for other uses such as fishing. Still further, boats which are suitable for pulling water-skiers at high speed across the surface of the water do not generally have sufficient accommodations for several people to sleep on them. A single boat structure which would have all of the above advantages and which would be relatively lightweight and trailerable, would be highly desirable.

Sponsons have been incorporated as part of power boat hulls to reduce, somewhat, high speed drag by reducing (at high speed only) the amount of hull surface which contacts the water. Such hulls have, however, had too much drag for efficient sailing operation (the entire hull contacts the water at low or sailing speeds) and are relatively heavy and not conveniently shaped for carrying on a trailer.

The present invention is directed to overcoming one or more of the problems as mentioned above.

DISCLOSURE OF THE INVENTION

Herein, a boat structure is disclosed which comprises a central hull having a lowermost portion, lateral sides having upper portions and being generally equally spaced from a central plane of symmetry of the central hull, the central hull being of a selected width at the waterline when floating at rest. The structure also includes a pair of side hulls having generally vertically extending infacing sides having top portions and bottom portions, the infacing sides being generally equally spaced a distance which is from about two-thirds to about four-thirds of the selected width, from the central plane, the bottom portions of the side hulls being spaced above the lowermost portion of the central hull and being positioned below the waterline when the hulls are floating at rest. Also part of the boat structure are a pair of substantially horizontal bridges extending substantially the length of the side hulls and connecting the top portions of the side hulls to the upper portions of the lateral sides of the central hull. The bottoms of the bridges are spaced well above the waterline, even when the hulls are floating at rest. Generally, the side hulls will extend from adjacent the bow to adjacent the stern of the boat structure.

A boat structure as just described has the advantage of being very efficient for pulling skiers when an outboard motor is attached to the stern, can be very readily sailed, has sufficient cabin space for fishing, and has sufficient space for sleeping as many as four persons. Also, the entire boat structure is small enough and convenient shaped so as to be trailerable, and is relatively light in weight.

BEST MODE FOR CARRYING OUT THE INVENTION

Figure 1:
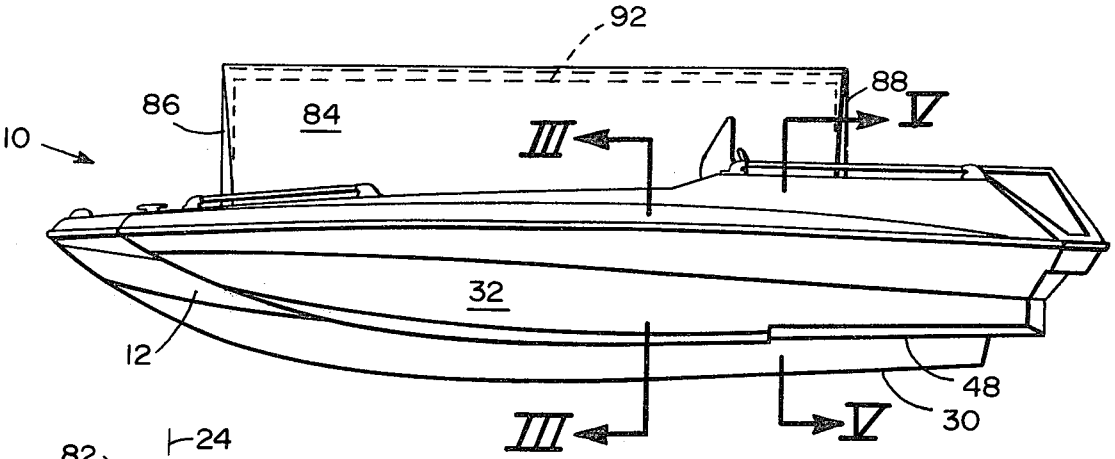
FIG. 1 illustrates, in side view, a boat structure in accordance with an embodiment of the present invention.
Figure 3:
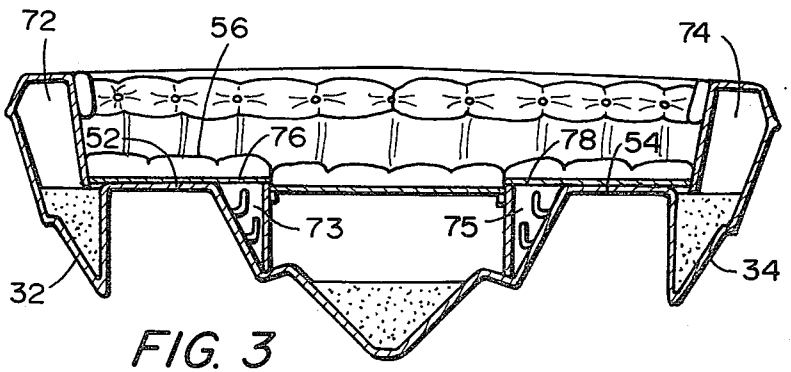
FIG. 3 illustrates a section view taken along the line III—III of FIG. 1.
Figure 2:
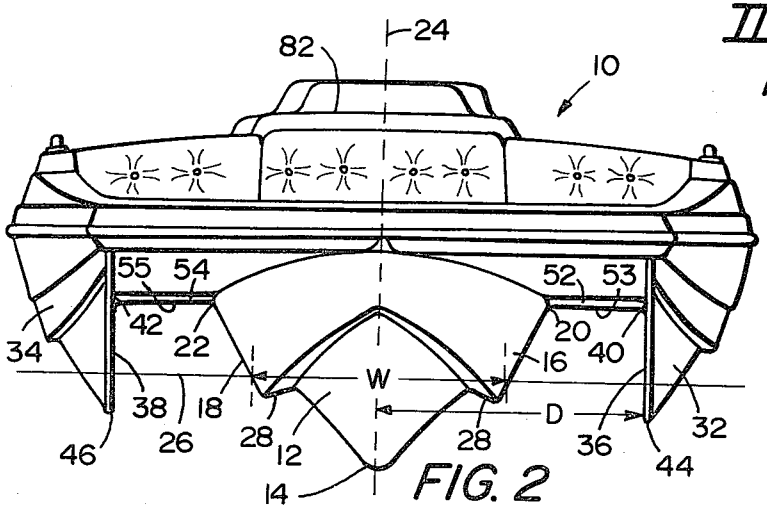
FIG. 2 illustrates, in front view, the boat of FIG. 1.

Adverting to FIGS. 1 and 2, a boat structure 10 is shown which includes a central hull 12 having a lowermost portion 14, lateral sides 16 (port) and 18 (starboard) having respective upper portions 20 and 22, the lateral sides 16 and 18 being generally equally spaced from a central plane 24 of symmetry of the central hull 12. The central hull 12 is of a width, W, at the waterline 26 when floating unloaded and at rest, as seen, for example, in FIG. 2. The overall width of the boat structure 10 will generally be about 2 to 2.3 meters so that it can be readily trailered. A fishing chair (not shown) can be removably mounted to an appropriate mounting bracket 29.

Figure 5:
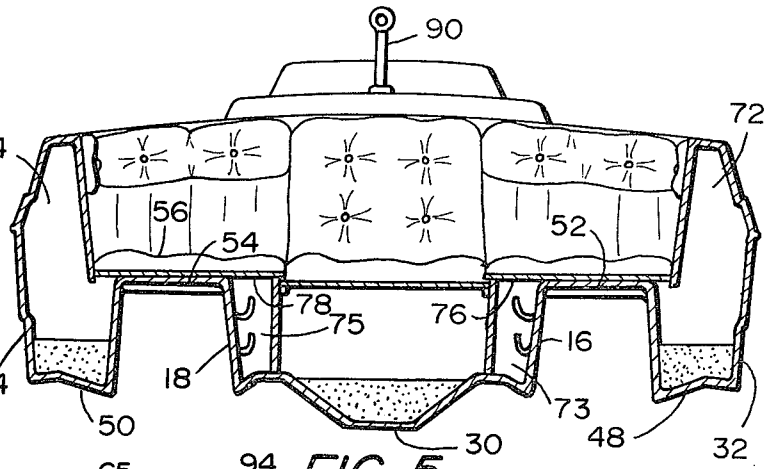
FIG. 5 illustrates a view taken along the line V—V of FIG. 1.
Figure 4:
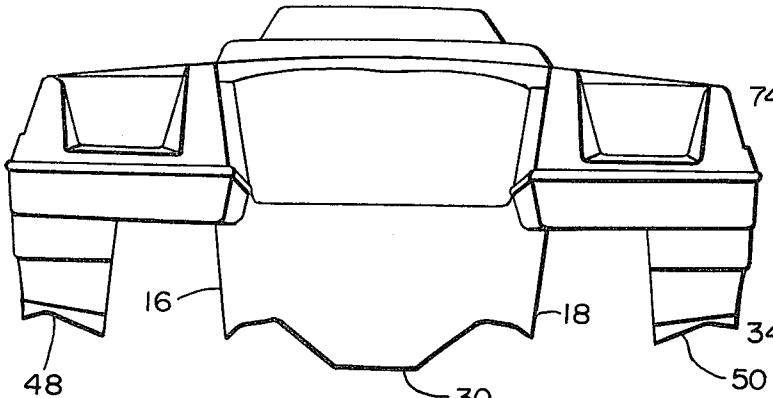
FIG. 4 illustrates a rear view of the boat of FIG. 1.

The central hull 12 is of a hydrolift variety and can have longitudinal sponsons or steps 28 for aiding lifting of the central hull 12. Thus, the central hull 12 smoothly rises in the water as it is propelled forwardly and maintains a semi-planing position along the aft portion 30 as seen in FIGS. 4 and 5.

Also in accordance with the present invention, a pair of side hulls 32, 34 (port and starboard) are present, one opposite each of the lateral sides 16 and 18 of the central hull 12. The side hulls 32 and 34 have generally vertically extending infacing sides 36 and 38 respectively which have top portion 40 and 42 respectively. The side hulls 32 and 34 also have bottom portions 44 and 46. The infacing sides 36 and 38 of the side hulls 32 and 34 are generally equally spaced an average distance, D, which is from about two-thirds to about four-thirds of the width, W, from the central plane 24. Preferably the distance, D, is from about five-sixths to about equal to the width, W. The bottom portions 44 and 46 of the side hulls 32 and 34 are spaced above the lowermost portion 14 of the central hull 12 and are positioned below the waterline 26 when the central hull 12 is floating at rest. A conventional centerboard (not shown) can be inserted through one of the side hulls 32 or 34 for sailing operation.

The top portions 40 and 42 of the side hulls 32 and 34 are spaced from the upper portions 20 and 22 of the lateral sides 16 and 18 from about one-sixth to about one-half of the width, W. Preferably, the spacing of the top portions 40 and 42 of the side hulls 32 and 34 from the upper portions 20 and 22 of the lateral sides 16 and 18 is from about one-fourth to about four-ninths of the width, W.

The overall length of the boat structure 10 should fall within a range of from about 2 to about 3.3 times its overall width to assure proper handling.

When the above set out ratios of distances to the width, W, of the central hull 12 are maintained and the overall length to overall width ratio is also maintained, the resulting boat structure 10 is of high stability, can move very fast when powered by an outboard motor, can sail well, has a relatively high area chain 47 (considering the overall width and length of the boat structure 10) and is of relatively light weight for the boat structure's 10 usable width and length.

The side hulls 32 and 34 preferably flatten at the respective aft portions 48 and 50 so as to aid in lifting of the central hull 12 and in the overall semi-planing operation of the boat structure 10.

Also in accordance with the present invention, a pair of substantially horizontal bridges 52 (port) and 54 (starboad), which extend substantially the length of the side hulls 32 and 34 and which have bottoms 53 and 55, serve for connecting the top portions 40 and 42 of the side hulls 32 and 34 to the upper portions 20 and 22 of the lateral sides 16 and 18 of the central hull 12. It is important that the bottoms 53,55 of the bridges 52,54 be spaced above the waterline 26, even when the hulls 12,32 and 34 are at rest. This ensures low drag when the boat structure 10 is moving slowly and easy lifting to hydroplaning height. Further, when the boat structure 10 is placed on a trailer it can be supported on the bottoms 53,55 of the bridges 52,54. The bridges 52 and 54 also serve as shelves upon which cushions 56 (FIG. 6) can be placed for seating or sleeping purposes. This provides the relatively wide cabin 47, which is then usable for fishing or sleeping, while maintaining the boat weight relatively low and while maintaining a trailerable size boat.

Figure 6:
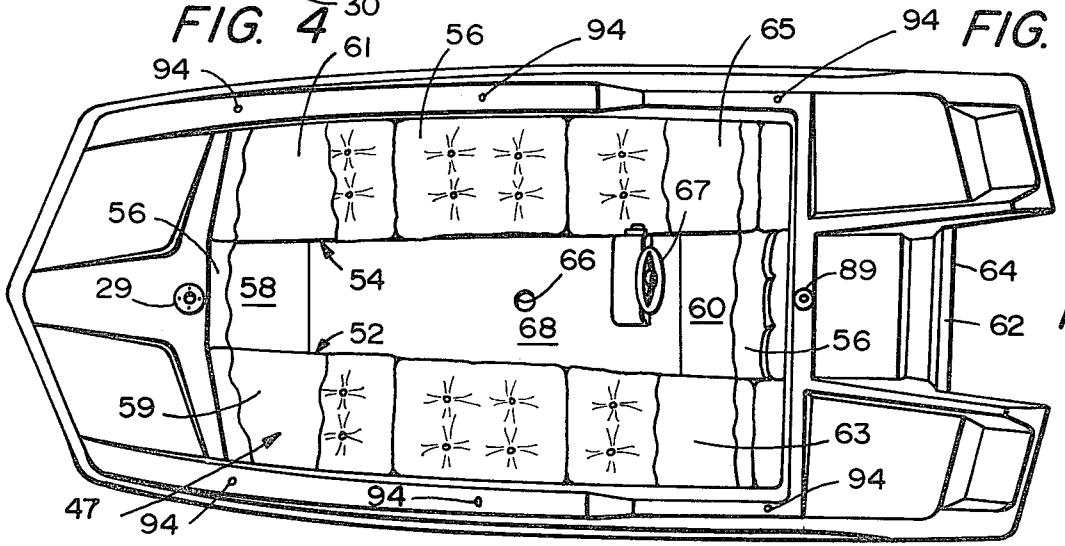
FIG. 6 illustrates a plan view of the boat of FIG. 1.
Figure 7:
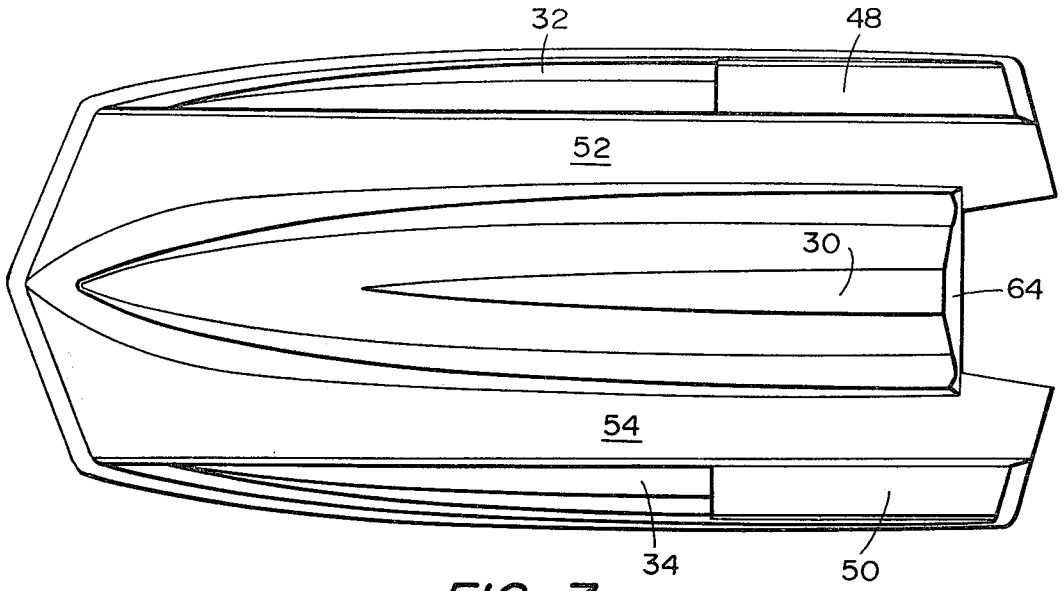
FIG. 7 illustrates a bottom view of the boat of FIG. 1.

Adverting principally to FIG. 6, it will be seen that a fore shelf 58 may span the distance between the forward ends 59,61 of the bridges 52 and 54 and an aft shelf 60 may span the distance between the aft ends 63,65 of the bridges 52 and 54. Additional cushions 56 may sit upon the fore shelf 58 and the aft shelf 60, thereby providing additional sitting space or sleeping space, as desired.

As may be seen in FIG. 6, a transom 62 may extend upwardly from an aft end 64 of the central hull 12. The transom 62 can be of a construction sufficient to serve as a mount for an outboard motor (not shown) to power the boat during skiing or other power operation. A steering wheel 67 can be appropriately positioned in the cabin 47.

Mast mounting means, for example, a mast well 66, may extend downwardly into a floor (or deck) 68 of the central hull 12. A mast (not shown) may be disassembled into two or more pieces of sufficiently limited length to be stored within lockers 72 and 74 which extend lengthwise interiorly of the side hulls 32 and 34. Other lockers (73,75) are provided interiorly of the lateral sides 16 and 18 of the central hull 12 and beneath respective lips 76 and 78 which extend inboard from the respective bridges 52 and 54.

The overall height of the boat structure 10, in the absence of the mast, from its top 82 to the bottom of its lowermost portion 14, is generally restricted to be less than about five-thirds of the width, W, of the central hull 12. More preferably, the top to bottom dimension falls between nine-sixths of the width, W and seven-sixths of the width, W. This provides a low profile both to minimize wind resistance during use and to make trailering as easy as possible.

The top portions 40 and 42 of the side hulls 32 and 34, are generally less than about one-third the width of the width, W, and more preferably less than about one-fourth the width of the width, W. The side hulls 32 and 34 are generally sized and positioned so that their bottom portions 44 and 46 are only skimming the surface of the water at high speed operation, as when the boat structure 10 is being driven by an outboard motor. This provides proper stability and cornering under various use conditions.

Also in accordance with the present invention, a tent 84 (FIG. 1) may be attached over the cabin 47 of the boat structure 10. For example, a pair of posts 86 and 88 can be mounted, one 86 to the bracket 29 and another 88 to a brackte 89 to which a skier towing post 90 (FIG. 5 only) normally is mounted. A pole 92 can be attached to the posts 86 and 88 and the tent 84 positioned over the pole 92, and to snaps 94 (FIG. 6), or the like, around the periphery of the cabin 47.

Industrial Applicability

The present invention is particularly useful for pleasure boats, which pleasure boats can be used to tow skiers, for fishing, for camping and for sailing. In the most preferred embodiment of the invention, the overall width of the boat structure 10, from the outside of the one side hull 32 to the outside of the other side hull 34, is only about 2 to 2.3 meters and the overall length of the boat structure 10, from its furthest fore portion to its furthest aft portion is only about 5 to 6.5 meters. This allows the entire boat structure 10 to be easily loaded on and off of and carried on a trailer. Still further, since only a very narrow central hull 10 is utilized. and since the side hulls 32 and 34 are relatively narrow, the weight of the boat is relatively low so that the boat structure 10 can be pulled by a relatively low powered automobile, even a compact car. Further, because of the relatively low weight of the boat structure 10, the gasoline mileage of the towing vehicle is not reduced as much as it would be in the case of a heavier boat.

Other aspects, objects and advantages of this invention can be obtained from a study of the drawings, the disclosure and the appended claims.

I claim:

1. A boat structure (10) comprising:

a central hull (12) having a lowermost portion (14), lateral sides (16, 18) having upper portions (20, 22) and being generally equally spaced from a central plane (24) of symmetry of the central hull (12), the central hull (12) being of a width (W) at the waterline (26) when floating at rest;

a pair of side hulls (32, 34) having infacing sides (36, 38) having top portions (40, 42) and bottom portions (44, 46), said infacing sides (36, 38) being generally equally spaced a distance (D), which is from about two-thirds to about four-thirds said width (W) from said plane (24) over generally the length of said side hulls (32, 34), the entire bottom portions (44, 46) of the side hulls (32, 34) being spaced above the lowermost portion (14) of the central hull (12) and being positioned below the waterline (26) when said hulls (12, 32, 34) are floating at rest; and a pair of substantially horizontal port and starboard bridges (52, 54) having bottoms (53, 55) and extending substantially the length of said side hulls (32, 34), said bridges (52, 54) connecting the top portions (40, 42) of the side hulls (32, 34) to the upper portions (20, 22) of the lateral sides (16, 18) of the central hull (12), the entire bottoms (53, 55)

of said bridges (52, 54) being spaced above the water line (26) when said hulls (12, 32, 34) are floating at rest.

2. A structure (10) as in claim 1, wherein said distance (D) is form about five-sixths to about equal to said width (W).

3. A structure (10) as in claim 1, wherein said top portion (40,42) of said side hulls (32,34) are spaced from said upper portions (20,22) of said lateral sides (16,18) from about one-sixth to about one-half of said width (W).

4. A structure (10) as in claim 3, wherein said top portions (40,42) of said side hulls (32,34) are spaced from said upper portions (20,22) of said lateral sides (16,18) about one-fourth to about four-ninths of said width (W).

5. A structure (10) as in claim 1, including at least one step (28) extending longitudinally along each of said lateral sides (16,18) of said central hull (12).

6. A structure (10) as in claim 1, wherein said central hull (12) and said side hulls (32,34) have respective flattened aft portions (30,48,50).

7. A structure (10) as in claim 1, including a transom (62) attached to said central hull (12) adjacent an aft end (64) thereof and being of a structure sufficient to have an outboard motor mounted thereto.

8. A structure (10) as in claim 1, wherein said central hull (12) includes mast mounting means (66) centrally thereof.

9. A structure (10) as in claim 1, including a fore shelf (58) connecting the port bridge (52) to the starboard bridge (54) at forward ends (59, 61) and an aft shelf (60) connecting the port bridge (52) to the starboard bridge (54) at aft ends (63, 65), said fore shelf (58) and aft shelf (60) being spaced from one another and defining, along with said bridges (52, 54) and said central hull (12), a cabin (47).

10. A structure (10) as in claim 1, wherein the largest dimension from the top (82) of the central hull (12) to the lowermost portion (14) thereof is less than about five-thirds of the width (W).

11. A structure (10) as in claim 10, wherein said distance lies in the range from nine-sixths of the width (W) to seven-sixths of the width (W).

12. A structure (10) as in claim 1, wherein said side hulls (32,34) are of a size and construction to contact the surface of the water when the central hull (12) is moving at its maximum speed across the water.

13. A structure (10) as in claim 1, including a mast storage locker (72,74) within at least one of the side hulls (32,34).

14. A structure (10) as in claim 1, wherein a width of the top portions (40,42) of the side hulls (32,34) is less than or equal to about one-third of the width (W).

15. A structure (10) as in claim 1, wherein the top portions (40,42) of the side hulls (32,34) are less than or equal to about one-fourth of the width (W).

16. A structure (10) as in claim 1, including a tent (84) attachable over a cabin (47) above the central hull (12) and the bridges (52,54).

* * * * *

UNITED STATES PATENT AND TRADEMARK OFFICE

CERTIFICATE OF CORRECTION

PATENT NO. : 4,348,972

DATED : September 14, 1982

INVENTOR(S) : VAUGHAN V. PARSONS

It is certified that error appears in the above—identified patent and that said Letters Patent is hereby corrected as shown below:

Column 3, line 6, "chain" should be "cabin".

Signed and Sealed this

*Twenty-eighth* Day of *December 1982*

[SEAL]

*Attest:*

GERALD J. MOSSINGHOFF

*Attesting Officer*

*Commissioner of Patents and Trademarks*